US010786032B2

(12) United States Patent
Hunt et al.

(10) Patent No.: US 10,786,032 B2
(45) Date of Patent: Sep. 29, 2020

(54) SKYDIVING HELMET AND VISOR MOUNTING SYSTEM

(71) Applicant: Cookie Composites Group Pty Ltd., Clontarf (AU)

(72) Inventors: Jeremy Robert Hunt, Bli Bli (AU); Jason Cooke, Parkwood (AU)

(73) Assignee: Cookie Composites Group PTY LTD. (AU)

( * ) Notice: Subject to any disclaimer, the term of this patent is extended or adjusted under 35 U.S.C. 154(b) by 41 days.

(21) Appl. No.: 16/251,516

(22) Filed: Jan. 18, 2019

(65) Prior Publication Data

US 2020/0229529 A1 Jul. 23, 2020

(51) Int. Cl.

| | |
|---|---|
| ***A42B 3/22*** | (2006.01) |
| ***A42B 3/28*** | (2006.01) |
| ***A42B 3/04*** | (2006.01) |

(52) U.S. Cl.

CPC ..... *A42B 3/223* (2013.01); *A42B 3/0493* (2013.01); *A42B 3/281* (2013.01)

(58) Field of Classification Search

CPC ..... A42B 3/223; A42B 3/22; A42B 3/222; A42B 3/221; A42B 3/224; A42B 3/225; A42B 3/228; A42B 3/185; A42B 3/20; A61F 9/06

USPC ..... 2/6.5, 424

See application file for complete search history.

(56) References Cited

U.S. PATENT DOCUMENTS 2,860,343 A * 11/1958 Aileo ..... A42B 3/225 2/9
3,345,642 A * 10/1967 Uminski ..... A42B 3/22 2/410
3,636,565 A * 1/1972 Luisada ..... A42B 3/226 2/410

(Continued)

FOREIGN PATENT DOCUMENTS

EP 0475318 A2 * 3/1992 ..... A42B 3/222
EP 0783842 A1 * 7/1997 ..... A42B 3/223

(Continued)

OTHER PUBLICATIONS

English language translation of FR2637468 to Chaise et al., obtained via espacenet.com (last visited Apr. 18, 2020) (Year: 2020).*

*Primary Examiner* — Alissa L Hoey
*Assistant Examiner* — Patrick J. Lynch
(74) *Attorney, Agent, or Firm* — Haugen Law Firm PLLP

(57) ABSTRACT

A skydiving helmet including a helmet shell having a front opening, is provided. The helmet further includes a visor having a lateral mounting section, where the visor is operable between a lowered position and a raised position. The skydiving helmet also includes a visor mounting system laterally positioned on the helmet shell to pivotally connect the lateral mounting section to the helmet shell. The visor mounting system includes a base plate having a cavity formed therein with a locking slot and a guiding section communicating with one another. The visor mounting system also includes a locking element positioned within the cavity and being operable between an extended configuration for preventing rotation of the visor, and a retracted configuration for allowing a frontward translation of the visor, away from the helmet front opening, and subsequent rotation of the visor, from the lowered to the raised position.

17 Claims, 12 Drawing Sheets

(56) References Cited

U.S. PATENT DOCUMENTS

| | | | | | |
|---|---|---|---|---|---|
| 4,170,792 | A | | 10/1979 | Higgs | |
| 4,292,688 | A | | 10/1981 | Ellis | |
| 4,305,160 | A | | 12/1981 | Sundahl | |
| 4,621,377 | A | | 11/1986 | Pennell | |
| 4,748,696 | A | * | 6/1988 | Fohl | A42B 3/223 2/10 |
| 4,907,300 | A | | 3/1990 | Dampney et al. | |
| 5,062,162 | A | * | 11/1991 | Kamata | A42B 3/222 2/424 |
| 5,073,990 | A | * | 12/1991 | Kamata | A42B 3/222 2/424 |
| 5,095,551 | A | | 3/1992 | Chin | |
| 5,177,816 | A | * | 1/1993 | Schmidt | A42B 3/221 2/424 |
| 5,184,231 | A | | 2/1993 | Ellis | |
| 5,329,642 | A | | 7/1994 | Dampney | |
| 5,333,329 | A | | 8/1994 | Hong | |
| 5,444,875 | A | * | 8/1995 | Taniuchi | A42B 3/326 2/424 |
| 5,604,930 | A | * | 2/1997 | Petit | A42B 3/22 2/424 |
| 6,301,721 | B1 | * | 10/2001 | Arai | A42B 3/222 2/424 |
| 6,622,313 | B1 | | 9/2003 | Choi et al. | |
| 6,732,380 | B1 | | 5/2004 | Lee | |
| 6,795,978 | B2 | | 9/2004 | Fournier et al. | |
| 6,851,129 | B2 | | 2/2005 | Gafforio et al. | |
| 7,225,471 | B2 | | 6/2007 | Sutter et al. | |
| 7,555,788 | B2 | | 7/2009 | Schimpf | |
| 8,011,025 | B2 | | 9/2011 | Lee | |
| 8,032,946 | B2 | | 10/2011 | Ishikawa | |
| 8,056,144 | B2 | * | 11/2011 | Gafforio | A42B 3/226 2/10 |
| 3,082,600 | A1 | | 12/2011 | Morin | |
| 8,166,577 | B2 | | 5/2012 | Lee | |
| 8,214,919 | B2 | | 7/2012 | Gafforio et al. | |
| 8,286,270 | B2 | | 10/2012 | Higgins | |
| 8,291,513 | B2 | | 10/2012 | Prinkey | |
| 8,635,715 | B2 | | 1/2014 | Hunt et al. | |
| 2003/0088907 | A1 | | 5/2003 | Gafforio et al. | |
| 2003/0182716 | A1 | | 10/2003 | Wu | |
| 2004/0049830 | A1 | | 3/2004 | Gafforio et al. | |
| 2006/0057972 | A1 | | 3/2006 | Wikel et al. | |
| 2006/0117467 | A1 | | 6/2006 | Choi et al. | |
| 2007/0074335 | A1 | | 4/2007 | Gafforio et al. | |
| 2007/0124851 | A1 | | 6/2007 | Pyo | |
| 2008/0196148 | A1 | | 8/2008 | Morin | |
| 2008/0216215 | A1 | | 9/2008 | Lee | |
| 2009/0300831 | A1 | | 12/2009 | Ishikawa | |
| 2011/0302701 | A1 | * | 12/2011 | Kuo | A42B 3/326 2/421 |
| 2013/0191976 | A1 | * | 8/2013 | Pizzi | A42B 3/223 2/424 |
| 2017/0215508 | A1 | * | 8/2017 | Salvetti | A42B 3/223 |
| 2018/0242677 | A1 | * | 8/2018 | Pilenga | A42B 3/185 |
| 2020/0029646 | A1 | * | 1/2020 | Salvetti | A42B 3/328 |

FOREIGN PATENT DOCUMENTS

| | | | | | |
|---|---|---|---|---|---|
| FR | 1446416 | A | * | 7/1966 | A42B 3/228 |
| FR | 1514503 | A | * | 2/1968 | B64D 1/00 |
| FR | 2637468 | A1 | * | 4/1990 | A42B 3/222 |
| JP | 04100911 | A | * | 4/1992 | |
| WO | WO-2007144938 | A1 | * | 12/2007 | A42B 3/222 |

* cited by examiner

SKYDIVING HELMET AND VISOR MOUNTING SYSTEM

TECHNICAL FIELD

The technical field generally relates to a protective helmet adapted for use in various activities and sports such as skydiving and motorcycling, and more specifically relates to a protective helmet having a visor mounting system to prevent inadvertent raising of the visor when wearing the helmet.

BACKGROUND

Historically, skydiving helmets were submitted to very few safety standards, as practitioners of the sport tended to allocate more importance to comfort and style. However, since the release of full-face skydiving helmets in the early 1990s, drop zones and skydiving centers have been setting pre-requisites relating to the gear (e.g., helmets) that the athletes/jumpers are using.

Skydiving helmets are now provided with mechanisms adapted to keep the visors lowered. However, there is still room for improvement, so that these mechanisms can be easily manipulated by the users, while still being able to maintain the visor lowered in high winds and pressure drops, and so that they can maintain their efficiency throughout the helmet's useful life.

There is thus a need for an improved visor mounting/locking system suitable for skydiving helmets.

SUMMARY

According to a first aspect, a skydiving helmet is provided. The skydiving helmet includes a helmet shell having a front opening and a visor having a lateral mounting section provided with a visor channel. The visor is operable between a lowered position for substantially covering the front opening, and a raised position. The skydiving helmet also has a visor mounting system laterally positioned on the helmet shell which includes a visor retaining pin insertable in the visor channel to pivotally connect the lateral mounting section of the visor to the helmet shell, and a base plate having a locking and guiding cavity formed therein. The locking and guiding cavity including a locking slot and an arcuate guiding section communicating with one another. The visor mounting system also includes a locking element positioned within the locking and guiding cavity operable between an extended configuration for engaging with the locking slot and preventing rotation of the visor, and a retracted configuration for fitting within and moving along the arcuate guiding section, thereby allowing a frontward translation of the visor, away from the helmet front opening, and subsequent rotation of the visor, from the lowered to the raised position.

According to a possible embodiment, the visor channel is sized and configured to retain the locking element therein when operating the locking element and/or pivoting the visor.

According to a possible embodiment, the visor channel is configured to align with the locking slot when the visor is in the lowered position.

According to a possible embodiment, the locking slot is recessed relative to the arcuate guiding section, the sidewalls of the locking slot constraining the motion of the locking element to a translational motion when in the extended configuration.

According to a possible embodiment, the locking element is operatively connected to the visor, and the visor is configured to disengage the locking element from the locking slot via a forward translation of the visor.

According to a possible embodiment, the arcuate guiding section of the locking and guiding cavity includes a stopper configured to limit movement of the locking element along the arcuate guiding section, thereby limiting rotational movement of the visor when the visor has reached the raised position.

According to a possible embodiment, the visor retaining pin has a stem connected to the base plate, and a pin head connected at a distal end of the stem, the pin head being shaped and configured to extend at least partially over the visor channel, thereby retaining the lateral mounting section pivotally connected to the helmet shell.

According to a possible embodiment, the locking element comprises a lock head, a lock base, and a resilient member extending between the lock head and lock base, the lock head being shaped and configured for engaging the locking slot; the lock base engaging with the stem of the visor retaining pin, and the resilient member biasing the lock head outwardly, away from the stem, such that it engages the locking slot when aligned therewith.

According to a possible embodiment, the visor mounting system includes a hub plate connected to the lateral mounting section of the visor such that moving the hub plate correspondingly moves the visor.

According to a possible embodiment, the hub plate is shaped and configured to cover the base plate and the locking element and is further configured to operate the locking element from the extended configuration to the retracted configuration via a forward translation thereof.

According to a possible embodiment, the resilient member is a compression spring that limits forward translation of the hub plate.

According to a possible embodiment, the hub plate includes a gripping surface to facilitate moving the visor.

According to a possible embodiment, the lock head includes a protrusion and the hub plate includes a lock recess for receiving the protrusion and connecting the lock head to the hub plate.

According to a possible embodiment, the hub plate includes a pin receiving cavity to receive the pin head therein and allow the pin head to slide and pivot within the pin receiving cavity when moving the hub plate.

According to a possible embodiment, the lock base of the locking element has an arcuate sidewall configured to pivot about the stem of the visor retaining pin when moving the locking element along the arcuate guiding section.

According to a possible embodiment, the arcuate guiding section of the guiding and locking cavity has an outer perimeter, and a radial distance between the stem and the outer perimeter of the cavity is constant along the arcuate guiding section, whereby when the visor is rotated from the lowered to the raised positions, spacing between the helmet shell and the visor is substantially constant.

According to a possible embodiment, the arcuate section has an outer perimeter, and a radial distance between the stem and the outer perimeter varies when moving away from the locking slot, whereby when the visor is rotated from the lowered to the raised positions, spacing between the helmet shell and the visor also varies.

According to a possible embodiment, the front opening has a recessed edge configured to block rotation of the visor when the visor is in the lowered position and the locking element is in the extended configuration.

According to a possible embodiment, the helmet shell includes air vents positioned below the front opening, near the mouth of the wearer, when in use.

According to a possible embodiment, the helmet shell and the base plate are formed as a one-piece unit.

According to a second aspect, a visor mounting system for connecting a visor to a skydiving helmet shell is provided. The visor mounting system includes a visor retaining pin engageable with the visor to pivotally connect a lateral section thereof to the helmet shell; a base plate having a locking and guiding cavity formed therein, the locking and guiding cavity including a locking slot and an arcuate guiding section communicating with one another; and a locking element positioned within the locking and guiding cavity, the locking element being operable between an extended configuration for engaging with the locking slot and preventing rotation of the visor, and a retracted configuration for fitting within and moving along the arcuate guiding section, thereby allowing a frontward translation of the visor, away from the helmet front opening, and subsequent rotation of the visor, from the lowered to the raised position.

According to a possible embodiment, the locking slot is recessed relative to the arcuate guiding section, and sidewalls of the locking slot constrain motion of the locking element to a translational motion when moved between the extended and the retracted configurations.

According to a possible embodiment, the locking element is operatively connected to the visor and is configured to disengage the locking slot upon moving the visor forward.

According to a possible embodiment, the arcuate guiding section of the locking and guiding cavity includes a stopper configured to limit movement of the locking element along the arcuate guiding section, thereby limiting rotational movement of the visor when the visor has reached the raised position.

According to a possible embodiment, the visor retaining pin has a stem connected to the base plate, and a pin head connected at a distal end of the stem, the pin head being shaped and configured to extend at least partially over the visor channel, thereby retaining the lateral mounting section pivotally connected to the helmet shell.

According to a possible embodiment, the locking element includes a lock head, a lock base, and a resilient member extending between the lock head and lock base, the lock head being shaped and configured for engaging the locking slot; the lock base engaging with the stem of the visor retaining pin, and the resilient member biasing the lock head outwardly, away from the stem, such that it engages the locking slot when aligned therewith.

According to a possible embodiment, the lock base of the locking element has an arcuate sidewall configured to pivot about the stem of the visor retaining pin when moving the locking element along the arcuate guiding section.

According to a possible embodiment, the visor mounting system includes a hub plate connected to the lateral mounting section of the visor such that moving the hub plate correspondingly moves the visor.

According to a possible embodiment, the hub plate is shaped and configured to cover the base plate and the locking element and is further configured to operate the locking element from the extended configuration to the retracted configuration via a forward translation thereof.

According to a possible embodiment, the resilient member is a compression spring that limits forward translation of the hub plate.

According to a possible embodiment, the hub plate includes a gripping surface to facilitate moving the visor.

According to a possible embodiment, the lock head includes a protrusion and the hub plate includes a lock recess for receiving the protrusion and connecting the lock head to the hub plate.

According to a possible embodiment, the hub plate includes a pin receiving cavity to receive the pin head therein and allow the pin head to slide and pivot within the pin receiving cavity when moving the hub plate.

According to a possible embodiment, the arcuate guiding section of the guiding and locking cavity has an outer perimeter, and wherein a radial distance between the stem and the outer perimeter of the cavity is constant along the arcuate guiding section, whereby when the visor is rotated from the lowered to the raised positions, spacing between the helmet shell and the visor is substantially constant.

According to a possible embodiment, the arcuate section has an outer perimeter, and wherein a radial distance between the stem and the outer perimeter varies when moving away from the locking slot, whereby when the visor is rotated from the lowered to the raised positions, spacing between the helmet shell and the visor also varies.

According to a third aspect, a method of adjusting a visor of a skydiving helmet from a lowered position to a raised position is provided. The skydiving helmet has a visor mounting system having a locking element movable in a locking and guiding cavity and being operable to allow rotation of the visor. The method includes the steps of operating the locking element from an extended configuration to a retracted configuration by moving the visor forward, thereby disengaging the visor from a front opening of the skydiving helmet; and rotating the locking element in the locking and guiding cavity for positioning the visor in a raised position.

According to a possible embodiment, the step of moving the visor forward includes manually pushing lateral sections of the visor forward.

DETAILED DESCRIPTION

In the following description, it should be noted that the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional and are given for exemplification purposes only.

Furthermore, although the various exemplary embodiments described herein may be used in relation with a skydiving helmet, it is understood that it may be used with other types of helmets, such as motorcycle helmets for example.

As will be explained below in relation to various embodiments, a skydiving helmet for protecting a wearer's head is provided. The skydiving helmet includes a helmet shell having a front opening, and a visor pivotally connected to the helmet shell for selectively covering the front opening. It will be understood that the expressions "visor", "face shield", "transparent shield", or any other variants thereof, may be used interchangeably in the context of the present disclosure. The skydiving helmet further includes a visor mounting system for operatively connecting the visor to the helmet shell. The visor mounting system is configured to prevent rotation of the visor (i.e., lock the visor in place) when the visor covers the front opening and allow rotation of the visor upon operation thereof, as will be explained below.

Figure 1:
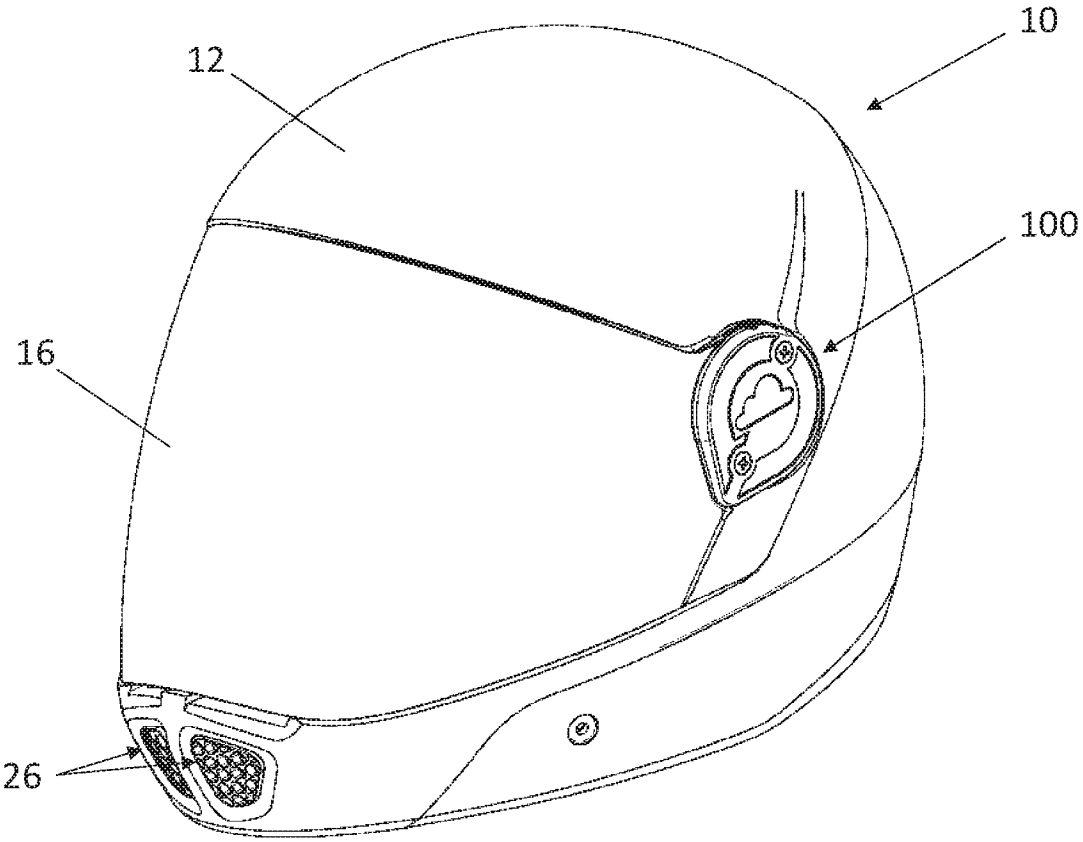
FIG. 1 is a perspective view of a skydiving helmet according to an embodiment.
Figure 2:
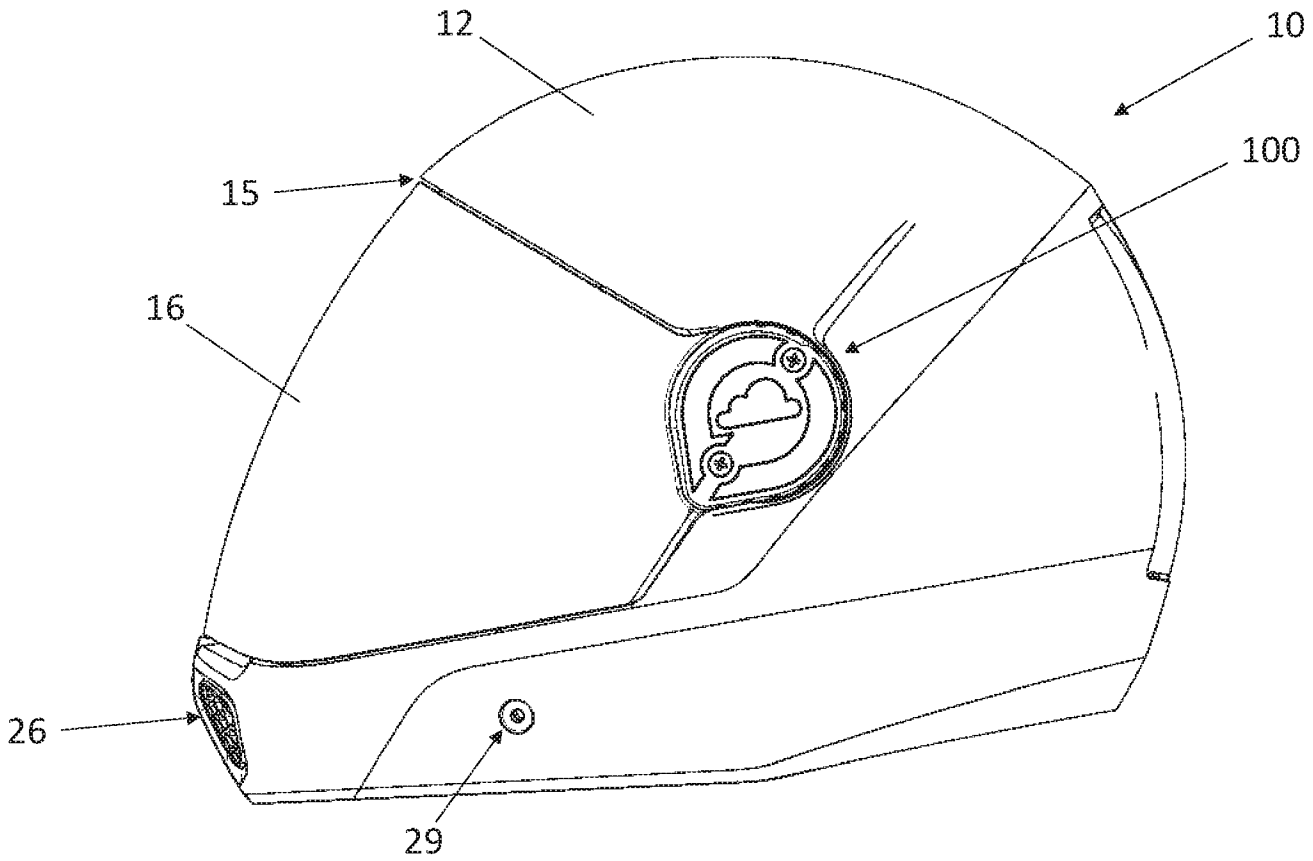
FIG. 2 is a side elevation view of the skydiving helmet shown in FIG. 1, showing the visor in a lowered position.
Figure 3:
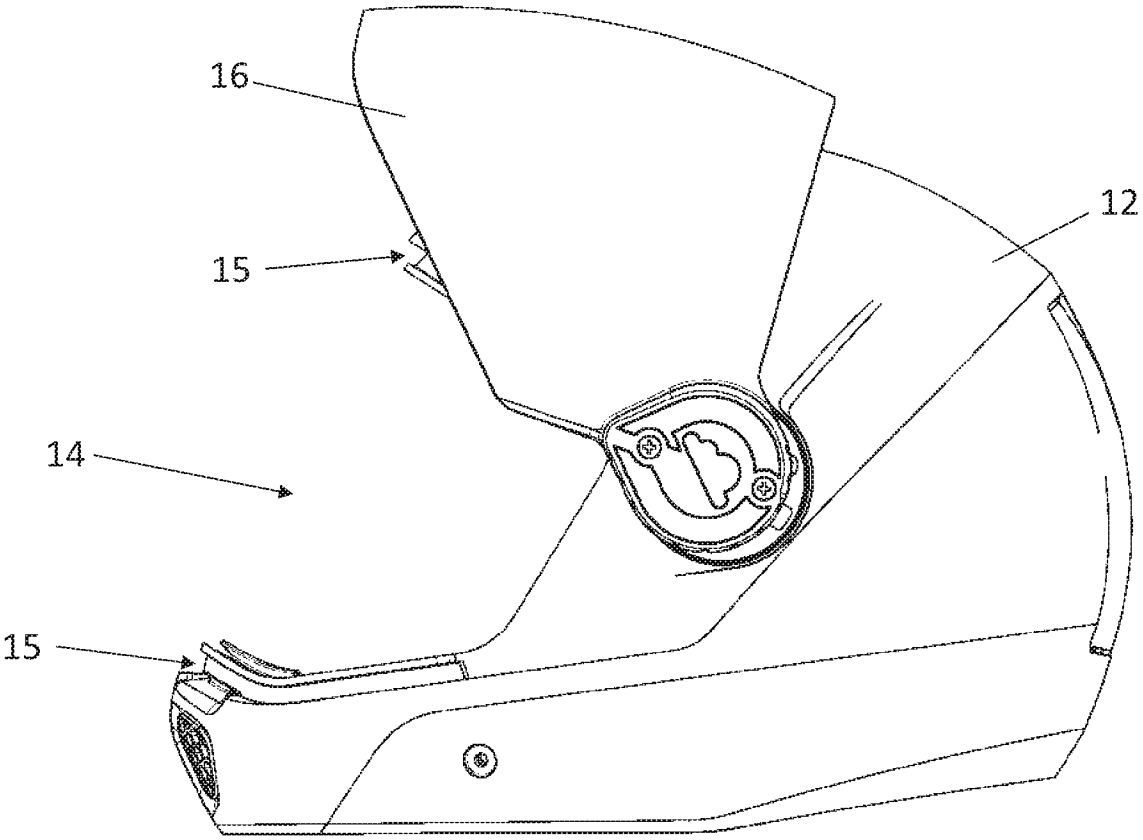
FIG. 3 is a side elevation view of the skydiving helmet shown in FIG. 1, showing the visor in a raised position.

Referring to FIGS. 1 to 3, a skydiving helmet 10 according to a possible embodiment is shown. The skydiving helmet 10 (hereafter simply "helmet") includes a helmet shell 12 having a front opening 14 (identified in FIG. 3) allowing the wearer to see. The helmet 10 further includes a visor 16 pivotally connected to the helmet shell 12 and operable between a lowered position, as seen in FIGS. 1 and 2, and a raised position, as seen in FIG. 3. When in the lowered position, the visor 16 covers the front opening 14 to protect the wearer's face and eyes. The helmet 10 is provided with a visor mounting system 100 laterally positioned on the helmet shell 12 for operatively connecting the visor 16 to the helmet shell 12. More specifically, the visor mounting system 100 is adapted to lock the visor 16 in the lowered position, therefore preventing rotation of the visor 16, and is operable to allow rotation of the visor 16 in a manner that will be described further below.

In the illustrated embodiment, the front opening 14 of the helmet shell 12 is provided with a recessed edge 15 shaped and configured to receive an outer edge of the visor 16 thereon. In other words, the visor 16 is adapted to sit/abut on the recessed edge 15 when in the lowered position. As seen in FIG. 2, when the visor 16 is engaged with the recessed edge 15, a shoulder formed by the helmet shell 12 prevents an upward rotation of the visor 16. As will be described further below, the visor mounting system 100 can be operated to allow the visor 16 to disengage the recessed edge 15, in a frontward translation of the visor, thereby allowing rotation of the visor 16 in the raised position, once it is moved away from the recessed edge 15.

Figure 4:
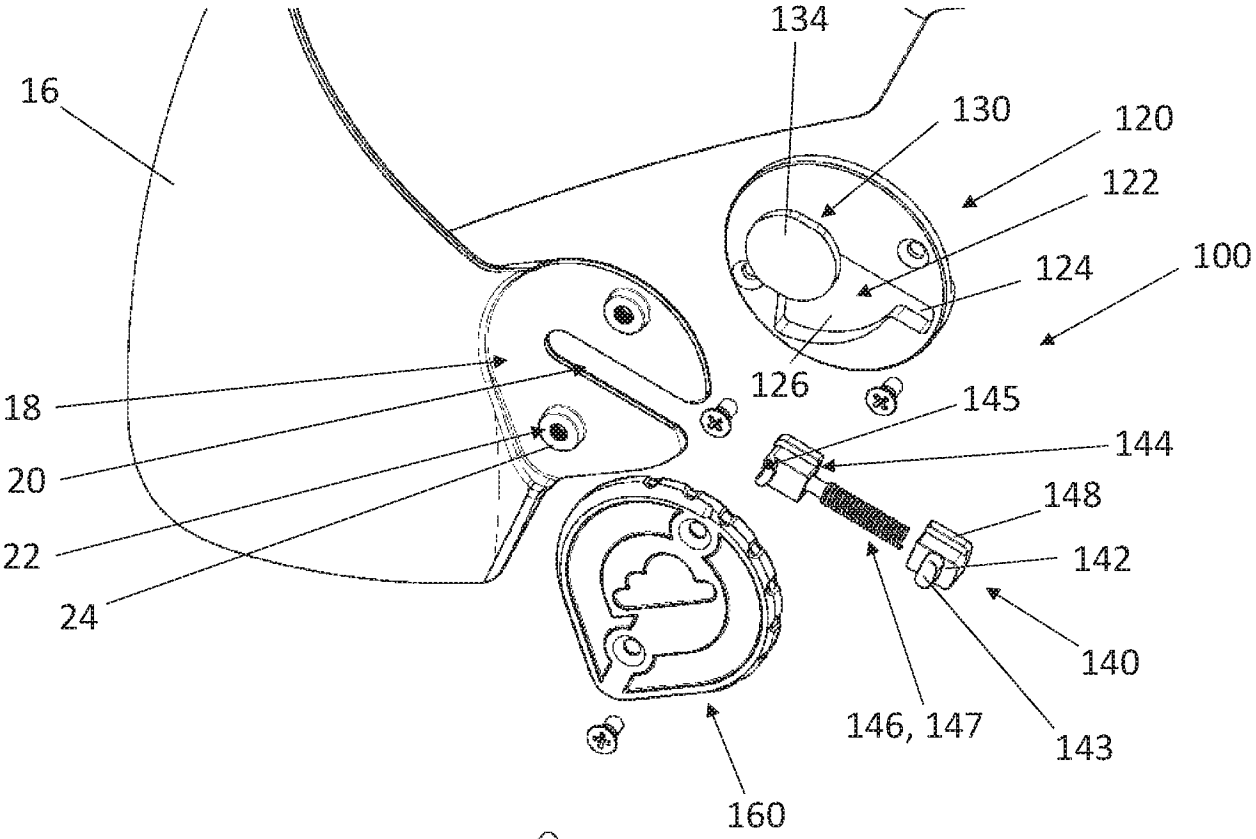
FIG. 4 is an exploded view of a visor mounting system according to an embodiment, showing various components of the visor mounting system and a lateral mounting section of the visor to which the mounting system connects.
Figure 5:
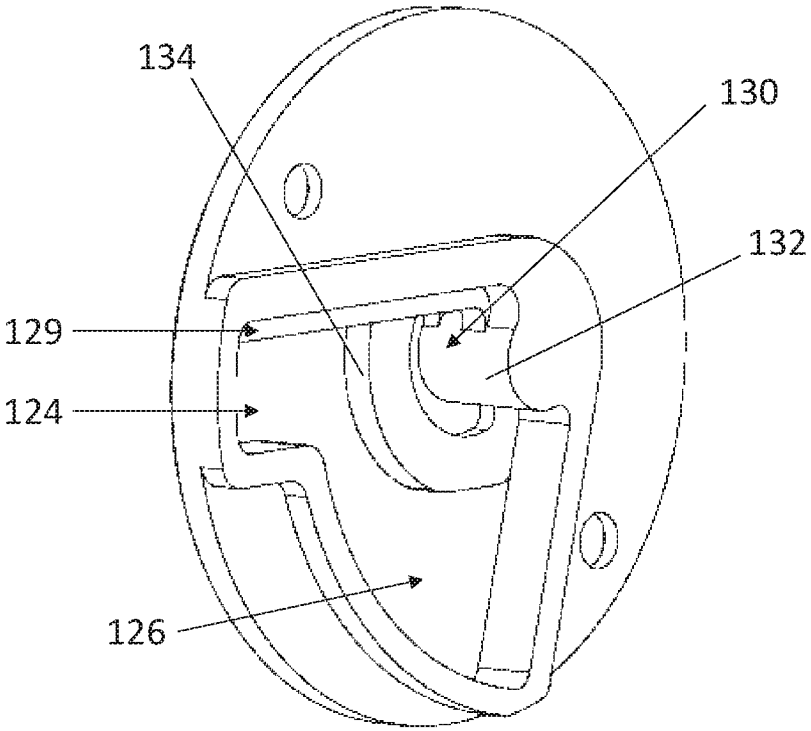
FIG. 5 is a rear perspective view of a base plate of the visor mounting system according to an embodiment, showing a visor retaining pin having a stem and a pin head.

Now referring to FIG. 4, the visor mounting system 100 includes various components for operatively connecting the visor 16 to the helmet shell 12. In the illustrated embodiment, the visor mounting system includes a base plate 120, a visor retaining pin 130, a locking element 140 and a hub plate 160. Broadly described, the base plate 120 is adapted to be connected to the helmet shell 12 and has a cavity 122 formed therein for housing the locking element 140. The visor retaining pin 130 (which is best shown in FIG. 5) is adapted to engage with the visor 16 in a manner allowing at least rotational movement thereof, thereby allowing users to operate the visor 16 between the lowered and the raised positions. Furthermore, the locking element 140 is shaped and configured to be positioned within the cavity 122 of the base plate 120 and cooperate therewith to lock the visor 16 and prevent rotation thereof. Moreover, the locking element 140 can be operated and displaced within the cavity to unlock the visor 16 and allow its rotation. Finally, the hub plate 160 is connected to the visor 16 and positioned over the base plate 120, the visor retaining pin 130 and the locking element 140 to at least provide protection to these components.

Still referring to FIG. 4, the visor 16 includes a lateral mounting section 18, configured to be pivotally connected to the helmet shell 12 via the visor mounting system 100, and more particularly, via the visor retaining pin 130. The visor retaining pin 130 can be adapted to engage with the lateral mounting section 18 in a manner allowing at least rotational movement of the lateral mounting section 18, and thus the visor 16. In the illustrated embodiment, the lateral mounting section 18 is provided with a visor channel 20 in which the visor retaining pin 130 can be inserted for operatively (e.g., pivotally) connecting the visor 16 to the helmet shell 12. In addition, the visor retaining pin 130 can cooperate with the visor channel 20 in a manner allowing translational movement of the visor 16.

With reference to FIG. 5, the visor retaining pin 130 preferably includes a stem 132 connected to the base plate 120, and a pin head 134 connected at a distal end of the stem 132. It is possible for the stem 132 to be removably connected to the base plate 120, or alternatively formed as a one-piece unit with the base plate 120, as illustrated. The pin head 134 can be shaped and configured to extend at least partially over the visor channel 20 and the surrounding area of the lateral mounting section 18. As such, axial movement of the lateral mounting section 18 (e.g., along the axis of the stem, away from the helmet shell) is limited due to the presence of the pin head 134. In this embodiment, the stem 132 is shaped and sized to be inserted within the visor channel 20 and can move or slide therealong, upon translating the visor 16. It is appreciated that the lateral mounting section 18 can be adapted to pivot about the stem 132 upon rotation of the visor 16, although other configurations are possible.

Still referring to FIGS. 4 and 5, the base plate 120 includes a locking and guiding cavity 122 formed therein for receiving the locking element 140. As will be described further below, depending on the position of the locking element 140 within the locking and guiding cavity 122, the visor 16 is either locked or unlocked for respectively preventing or allowing rotation of the visor 16. In this embodiment, the locking and guiding cavity 122 includes a locking slot 124 and an arcuate guiding section 126 communicating with one another. In some embodiments, it is appreciated that when the locking element 140 is positioned within the locking slot 124, the visor 16 is locked, and that when the locking element 140 is positioned within the arcuate guiding section 126, the visor 16 is unlocked. In some embodiments, the base plate 120 is connected to the helmet shell via mechanical fasteners (e.g., screws), although it is appreciated that any other suitable fasteners or fastening means can be used, such as an adhesive for example. Alternatively, it is appreciated that the base plate 120 can be integrally formed with the helmet shell such that the locking and guiding cavity 122 is defined in a thickness of the helmet shell.

Figure 6B:
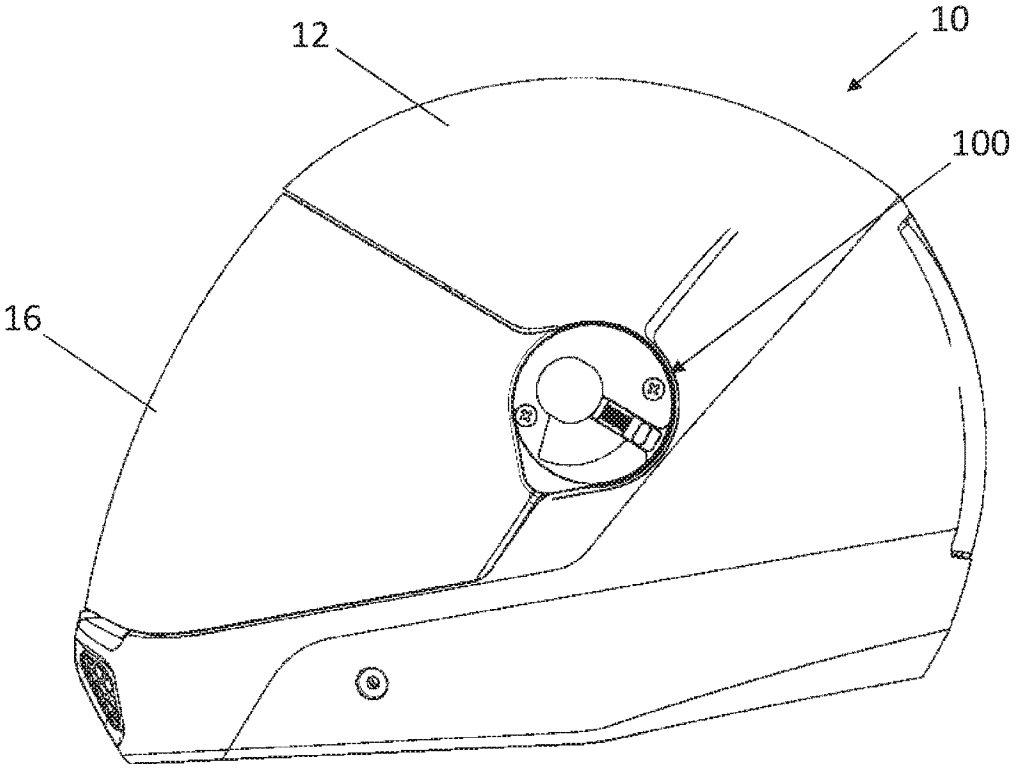
FIG. 6B is a side elevation view of the skydiving helmet, showing the position of the visor corresponding to the configuration of the visor mounting system shown in FIG. 6A.
Figure 6A:
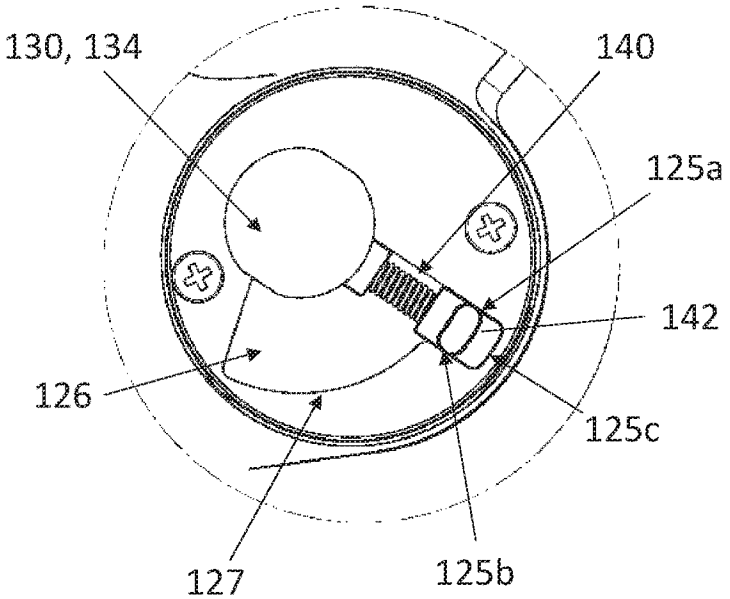
FIG. 6A is a front elevation view of the visor mounting system, showing a locking element in an extended configuration within a locking slot.

In this embodiment, the locking element 140 is shaped and configured to engage the locking and guiding cavity 122 of the base plate 120 for either allowing or preventing rotation of the visor 16. The locking element 140 is thus operable between an extended configuration (as shown in FIG. 6A), whereby rotation of the visor 16 is prevented, and a retracted configuration (as in FIGS. 7A, 8A and 9A) for allowing rotation of the visor 16. Preferably, the locking element 140 has an elongated shape, as illustrated, but other configurations are possible. It should thus be understood that the extended configuration corresponds to the visor 16 being locked, and that the retracted configuration corresponds to the visor 16 being unlocked. In this embodiment, the locking element 140 is operatively connected to the visor 16 in a manner such that moving the visor 16 operates the locking element 140 between the extended and retracted configurations. More specifically, moving the visor 16 in a forward translation (i.e., away from the front opening), effectively moves the locking element 140 in the retracted configuration. Preferably, as per the illustrated embodiment, the visor 16 is moved by the user by pushing the hub plate 160 frontwardly, the hub plate and visor being connected together.

Figure 7B:
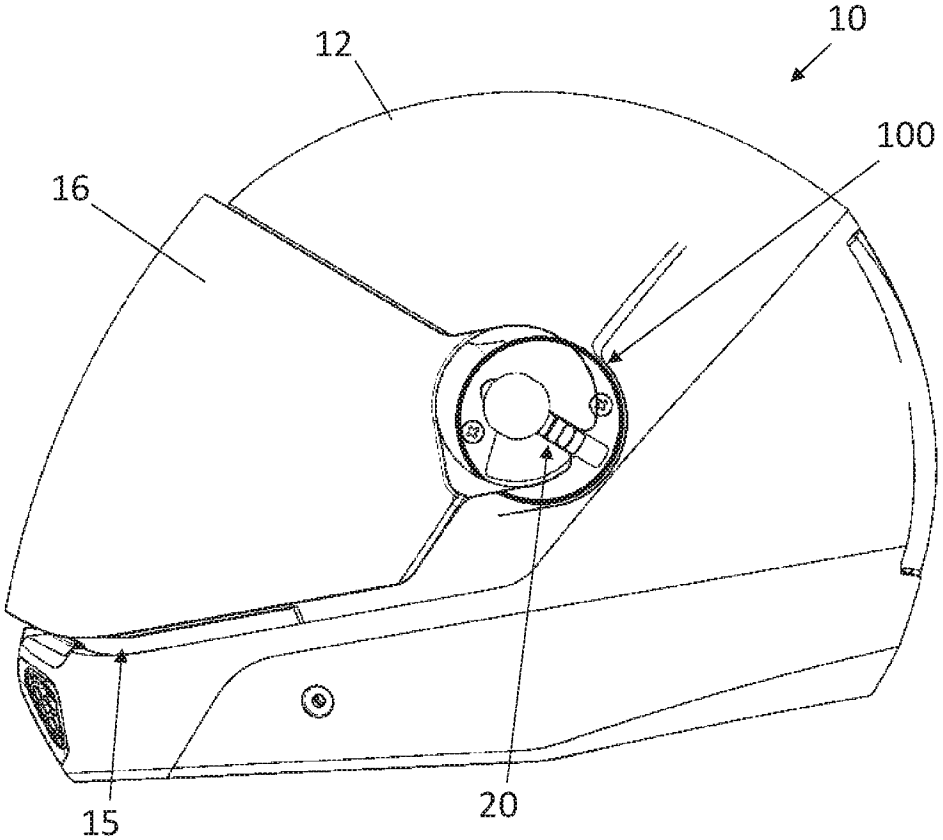
FIG. 7B is a side elevation view of the skydiving helmet, showing the position of the visor corresponding to the configuration of the visor mounting system shown in FIG. 7A.

As best shown in FIG. 7B, the locking element 140 can be shaped and sized to fit within the visor channel 20 of the lateral mounting section 18. More particularly, the visor channel 20 is shaped and configured to retain the locking element 140 therein when operating the visor 16 (i.e., between the lowered and raised positions) and/or the locking element 140 (i.e., between the extended and retracted configurations). It should thus be understood that, when pivoting the visor 16, the locking element 140 correspondingly rotates within the locking and guiding cavity 122, and more specifically moves along the arcuate guiding section 126.

Referring back to FIG. 4, the locking element 140 can include a lock head 142, a lock base 144, and a resilient member 146 extending between the lock head 142 and the lock base 144. In this embodiment, the lock head 142 is shaped and configured to engage the locking slot 124 for blocking rotational movement of the visor 16, and the lock base 144 is configured to engage with the stem 132 (FIG. 5) of the visor retaining pin 130. The lock base 144 also preferably has an arcuate sidewall 145 configured to mate the shape of the retaining pin stem 132, so as to facilitate pivoting the locking element about the stem. In this embodiment, the arcuate sidewall 145 simply abuts the stem 132 when pivoting about it. However, it is appreciated that the lock base 144 can be pivotally connected to the stem 132 in a manner preventing disengagement of the lock base 144 therefrom.

Still referring to FIG. 4, and also to FIG. 5, in some embodiments, the locking and guiding cavity 122 is preferably provided with a side flange 129 (identified in FIG. 5) and the locking element 140 can include a protruding edge 148 adapted to engage the side flange 129 for preventing accidental disengagement of the locking element 140 from the locking and guiding cavity 122. More specifically, the side flange 129 is defined along a sidewall of the locking and guiding cavity 122 such that, when the locking element 140 abuts said sidewall, the protruding edge 148 engages the side flange 129 by sliding thereunder. In this embodiment, the protruding edge 148 extends laterally from the lock base 144 and/or the lock head 142, although it is appreciated that other configurations are possible.

In this embodiment, the resilient element 146 is adapted to bias the lock head 142 outwardly (e.g., away from the stem 132) such that the lock head 142 engages the locking slot 124 when aligned therewith. In addition, the resilient element 146 can be adapted to bias the lock base 144 towards the stem 132 to maintain the lock base 144 engaged therewith. In the illustrated embodiment, the resilient element 146 is a spring, and more particularly a compression spring 147 configured to push the lock head 142 and lock base 144 in opposite directions for engaging the locking slot 124 and the stem 132 respectively. As such, it should be understood that when the locking element 140 is aligned with the locking slot 124, the compression spring 147 reverts/extends and pushes the lock head 142 within the locking slot 124, effectively moving the visor 16 backwards in order to engage the recessed edge of the front opening. Other types of resilient elements can be considered, such as resilient/compressible polymers for example.

Still referring to FIGS. 4 and 5, and also to FIGS. 6A to 9B, the locking slot 124 is preferably recessed relative to the arcuate guiding section 126 and includes sidewalls 125 adapted to prevent rotation of the locking element 140. In the illustrated embodiment, the locking slot 124 is a substantially rectangular shape, with the bottom sidewall 125*c* of the slot being at a greater radial distance from the retaining pin 130, than that of the arc-shaped sidewall 127 of the arcuate section 126. The sidewalls 125*a*, 125*b* are configured and dimensioned to constrain the motion of the locking element 140 to a translational movement. As seen in FIG. 6B, the extended configuration of the locking element 140 corresponds to the visor 16 being in the lowered position, engaged with the recessed edge of the front opening.

Figure 7A:
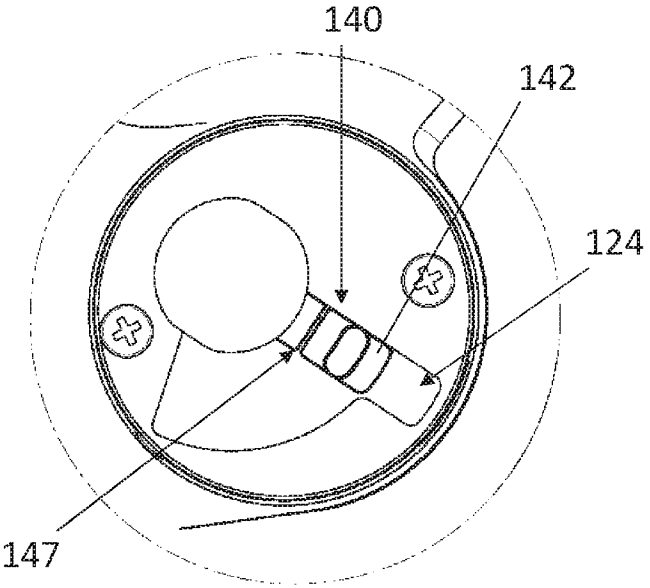
FIG. 7A is a front elevation view of the visor mounting system, showing the locking element in a retracted configuration and aligned with a locking slot.

Referring more specifically to FIGS. 7A and 7B, it is appreciated that moving the visor 16 forward effectively compresses the spring 147 and disengages the lock head 142 from the locking slot 124. In other words, moving the visor 16 forward, via the hub plate 160, moves the locking element 140 in the retracted configuration. It should be noted that, prior to rotating the visor 16, the lock head 142 remains aligned with the locking slot 124. It is further noted that the configuration of the locking element 140 illustrated in FIG. 7A corresponds to the visor 16 being in the lowered position but disengaged from the recessed edge 15 of the front opening, as illustrated in FIG. 7B. In other words, FIG. 7B shows the visor 16 after having been translated frontwardly, away from the user's face, but still in the lowered position. Similarly, when the visor 16 is lowered after having been opened, the visor channel 20 aligns back with the locking slot 124 such that the lock head 142 is pushed, via the compression spring 147, within the locking slot 124, thereby re-engaging the visor 16 within the front opening.

Figure 8B:
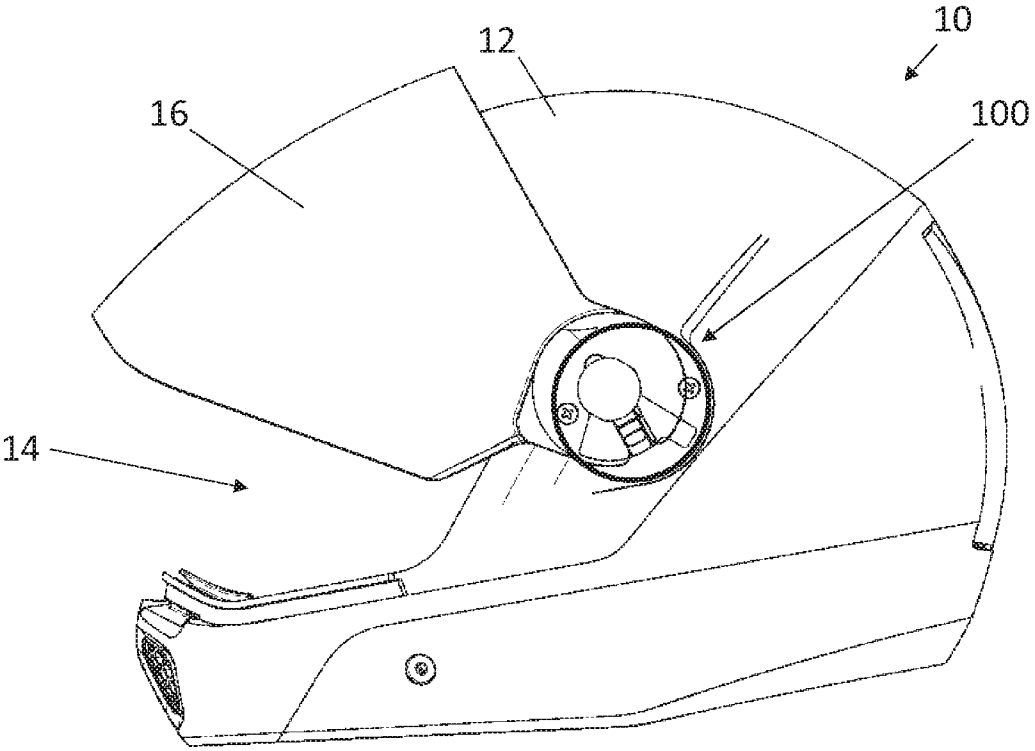
FIG. 8B is a side elevation view of the skydiving helmet, showing the position of the visor corresponding to the configuration of the visor mounting system shown in FIG. 8A.
Figure 8A:
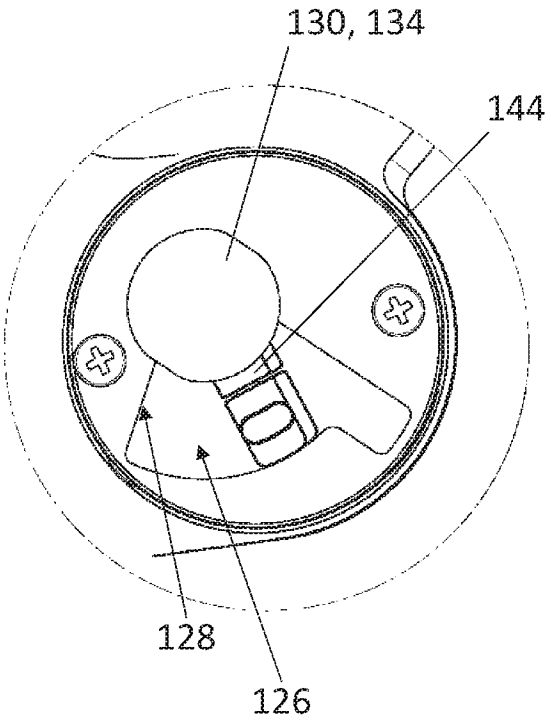
FIG. 8A is a front elevation view of the visor mounting system, showing the locking element in a retracted configuration and rotated within an arcuate guiding section.
Figure 9B:
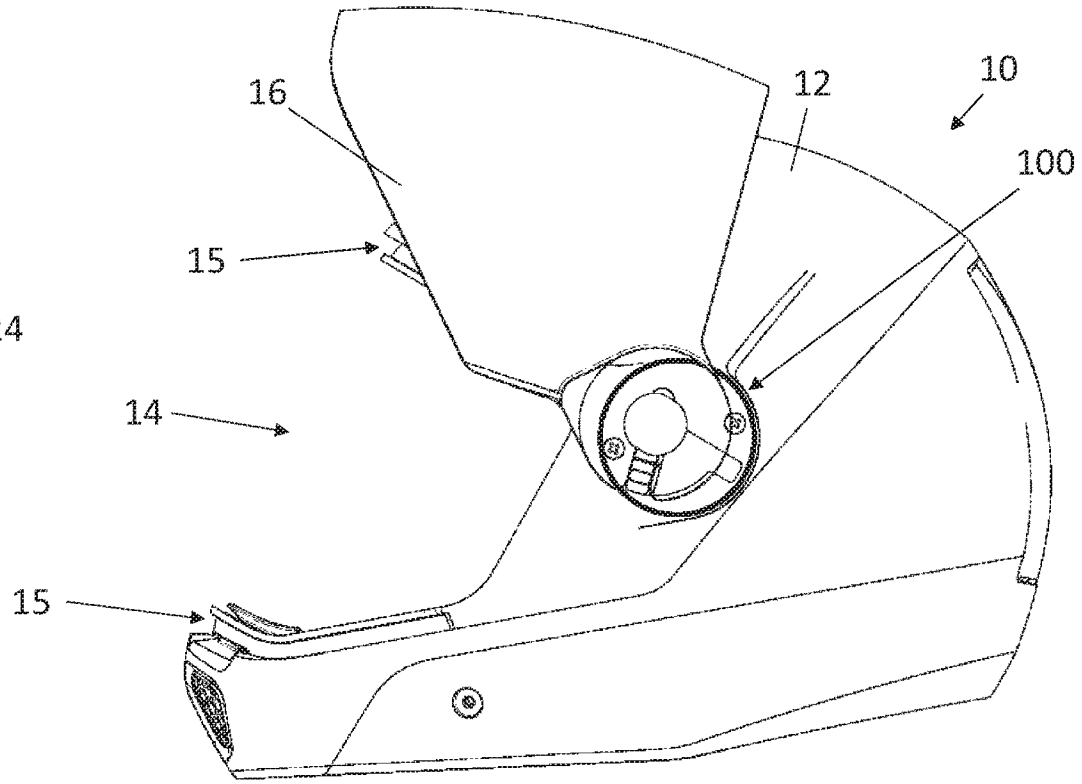
FIG. 9B is a side elevation view of the skydiving helmet, showing the position of the visor corresponding to the configuration of the visor mounting system shown in FIG. 9A.
Figure 9A:
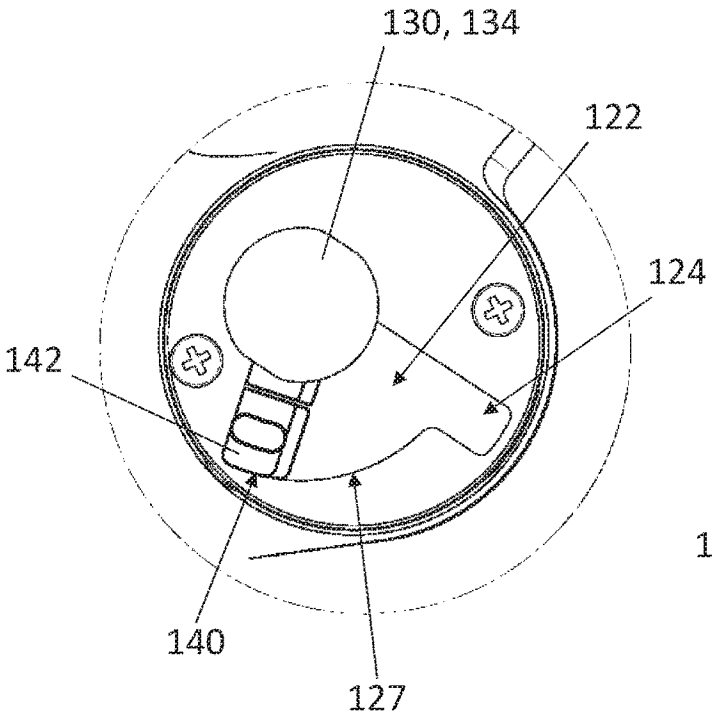
FIG. 9A is a front elevation view of the visor mounting system, showing the locking element in a retracted configuration and contacting a stopper within the arcuate guiding section.

As shown in FIGS. 8A and 9A, when the locking element 140 is in the retracted configuration, it is positioned to fit within the arcuate guiding section 126. As described above, the locking element 140 moves along the arcuate guiding section 126 as the lock base 144 pivots about the stem of the visor retaining pin 130. In this embodiment, moving the locking element 140 along the arcuate guiding section 126 correspondingly pivots the visor 16, as seen in FIGS. 8B and 9B. In some embodiments, the arcuate guiding section 126 includes an end wall which acts as a stopper 128 and limits movement of the locking element 140 along the arcuate guiding section 126, which in turn limits rotational movement of the visor 16. In other words, when the locking element 140 contacts the stopper 128, the visor 16 has reached the raised position (FIG. 9B). In this embodiment, the stopper 128 corresponds to one of the sidewalls of the locking and guiding cavity 122, although it is appreciated that other configurations are possible.

Figure 10:
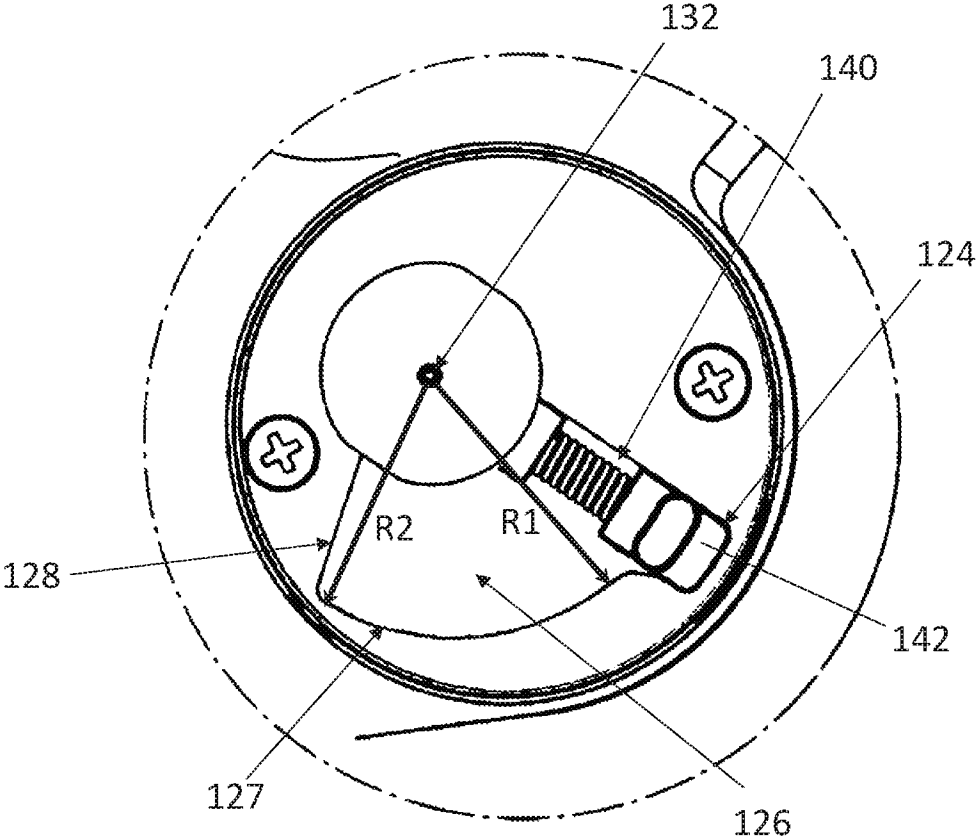
FIG. 10 is a front elevation view of an alternate visor mounting system, showing an arcuate guiding section having an eccentric curve.

Now referring to FIG. 10, in addition to FIGS. 9A and 9B, the arcuate guiding section 126 has an outer periphery, or outer wall 127, along which the lock head 142 of the locking element 140 slides when pivoting the visor 16. In some embodiments, the radial distance between the stem 132 of the visor retaining pin 130 and the outer wall 127 is substantially constant (FIG. 9A). As such, movement of the visor 16 is exclusively rotational when moving along the arcuate section, thereby maintaining a substantially constant spacing between the helmet shell 12 (e.g., a top section thereof) and the visor, as the visor 16 rotates. Alternatively, and as illustrated in FIG. 10, the radial distance between the stem 132 of the visor retaining pin 130 and the outer wall 129 can vary along the arcuate guiding section 126. For example, the radial distance R1 proximate the locking slot 124 can be greater than the radial distance R2 proximate the stopper 128. Consequently, the locking element 140 will at least partially retract or extend during movement of the visor 16, creating a combination of rotational and translational movements, i.e., the movement of the visor 16 is eccentric as it rotates.

Figure 11:
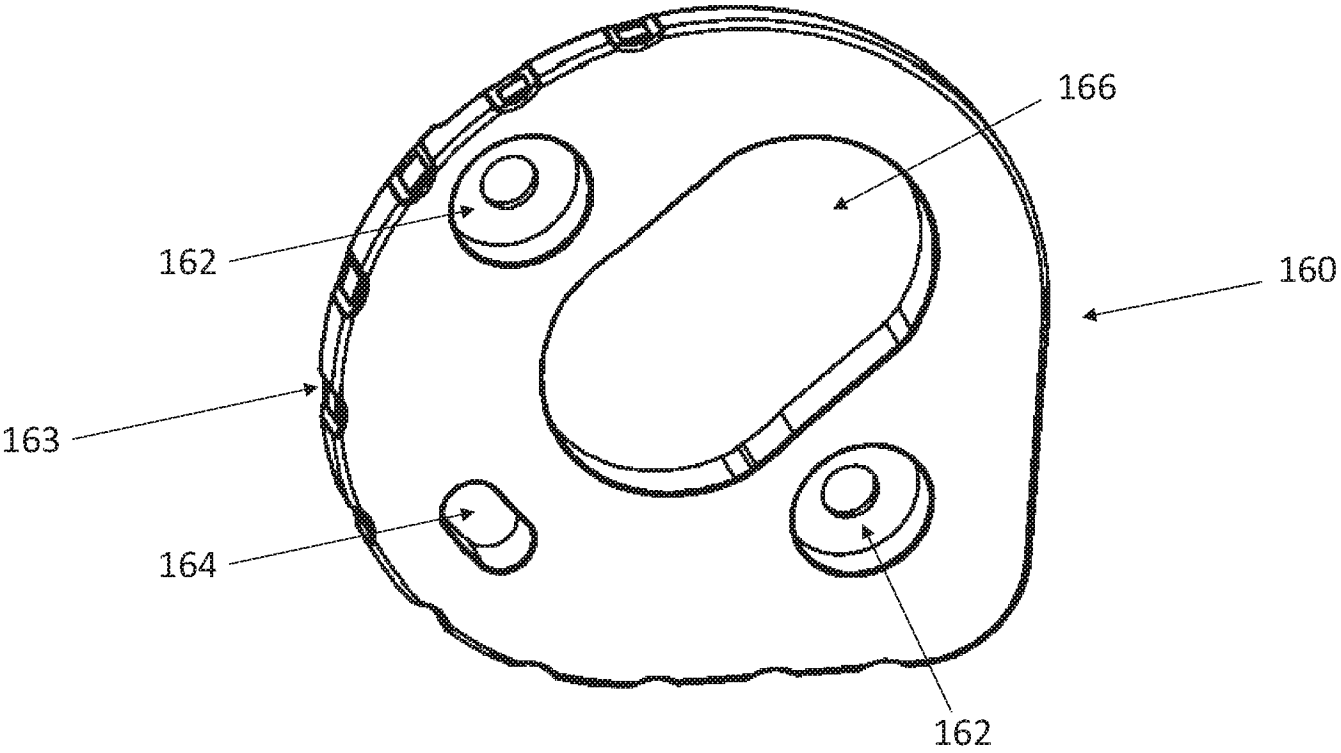
FIG. 11 is a rear view of a hub plate of the visor mounting system according to an embodiment, showing various cavities for connecting the hub plate to other components.

Referring to FIG. 11, in addition to FIG. 4, the hub plate 160 of the visor mounting system 100 is adapted to be connected to the lateral mounting section 18 of the visor 16 using any suitable fasteners, such as screws for example. It should thus be understood that moving the hub plate 160 correspondingly moves the visor 16. For example, pushing the hub plate 160 forwardly when the visor 16 is in the lowered position (FIG. 6B) effectively moves the visor 16 forward and disengages the front opening (FIG. 7B). Moreover, it should be further understood rotating the hub plate 160 correspondingly rotates the visor 16 in the same direction. In some embodiments, the lateral mounting section 18 can include fastener holes 22 respectively having a flange 24 engageable with the hub plate 160 to further secure the hub plate 160 to the lateral mounting section 18. As seen in FIG. 11, the hub plate 160 can be provided with one or more flange receiving cavities 162 shaped and configured for receiving a corresponding one of the flanges 24.

In some embodiments, the hub plate 160 can further be operatively connected to the locking element 140 such that moving the hub plate 160 operates the locking element 140 between the extended and retracted configurations. More specifically, moving the hub plate 160 forward effectively translates the visor 16 forward and therefore retracts the locking element 140, i.e., disengages the lock head 142 from the locking slot 124. In this embodiment, the hub plate includes a gripping surface 163 shaped and adapted to facilitate manually moving the hub plate 160. More particularly, the gripping surface 163 can be configured to increase the user's grip on the hub plate 160, therefore reducing the risk of slipping when moving/rotating the hub plate 160. In this embodiment, the gripping surface 163 is defined along an outer rim of the hub plate 160. However, it is appreciated that other configurations of the gripping surface 163 are possible, such as being defined across a top surface of the hub plate 160 for example.

In this embodiment, the lock head 142 of the locking element 140 includes a protrusion 143 (FIG. 4) extending therefrom for engaging the hub plate 160. As seen in FIG. 11, the hub plate 160 can include a lock recess 164 shaped and configured to receive the protrusion 143 of the lock head 142, effectively connecting the locking element 140 to the hub plate 160. In addition, the hub plate 160 can be provided with a pin receiving cavity 166 shaped and configured to receive the pin head 134 of the visor retaining pin 130. In this embodiment, the pin receiving cavity 166 is shaped in a manner allowing the pin head 134 to slide and pivot therein when moving the hub plate 160. More specifically, the pin receiving cavity 166 is substantially oblong to allow the circular pin head to pivot and slide along the oblong cavity 166. It should be noted that, in this embodiment, the hub plate 160 is connected to the lateral mounting section 18 of the visor 16 (via fasteners), to the base plate 120 (via the visor retaining pin 130), and to the locking element 140 (via the protrusion 143).

Figure 12:
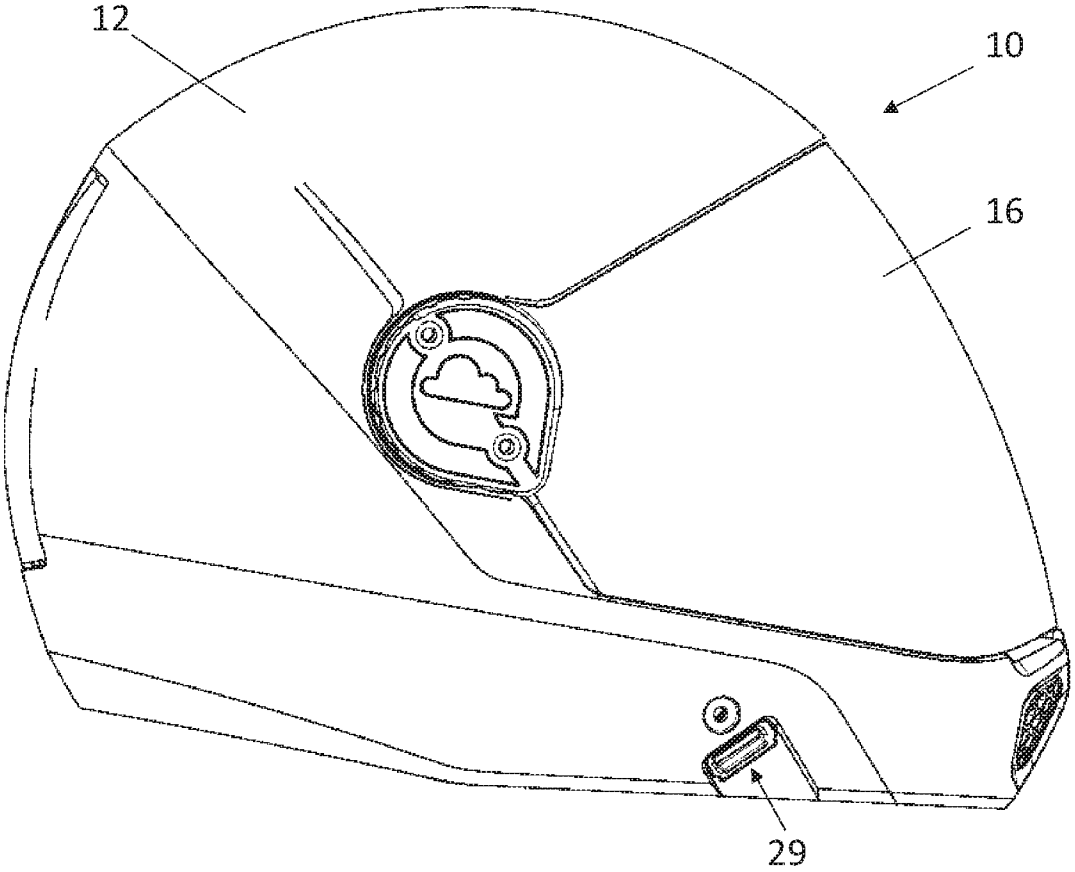
FIG. 12 is a side elevation view of the skydiving helmet according to an embodiment, showing a helmet strap connector.

Referring back to FIGS. 1 to 3, the helmet 10 can be provided with a ventilation system adapted to establish fluid communication between the interior of the helmet 10 and the surrounding environment. In this embodiment, the helmet 10 includes one or more air vents 26 positioned below the front opening 14, substantially opposite the mouth of the wearer when wearing the helmet 10. The helmet 10 can further be provided with means to connect a strap (not shown) for securing the helmet 10 on the head of the wearer. As best seen in FIGS. 2 and 12, the helmet 10 can include a strap connector 28 (FIG. 12) for connecting a first end of the strap, and a corresponding fastening cavity 29 (FIG. 2) for connecting a second end of the strap to the helmet shell 12 via a snap-fit connection for example. It is appreciated that the strap connecting means are exemplary, and that other configurations are possible, such as connecting the strap inside the helmet shell 12 for example.

Referring broadly to FIGS. 1 through 12, a method of adjusting the visor 16 between the lowered and raised positions will now be described. First, from the lowered position, as seen in FIG. 2, the locking element 140 is operated from the extended configuration to the retracted configuration by manually moving the visor 16 forward via a forward translation of the hub plate 160. Once the locking element 140 is in the retracted configuration, as seen in FIGS. 7A and 7B, the visor is still in a disengaged but lowered position, and the hub plate 160 can be manually rotated, rotating the visor 16 and engaging the locking element 140 within the arcuate guiding section 126 of the locking and guiding cavity 122. The hub plate 160 is rotated as such until the visor 16 reaches the raised position. In order to return to the lowered position, the visor 16 is rotated downwardly, either directly or via the hub plate 160, in order to move the locking element 140 towards the locking slot 124 of the locking and guiding cavity 122. Once the locking element 140 is aligned with the locking slot 124, the compression spring 147 will extend and push the lock head 142 within the locking slot 124, effectively positioning the visor 16 in the lowered position.

It should be appreciated that, in one embodiment, the skydiving helmet 10 can be provided with a single visor mounting system 100 as described above on one side of the helmet shell 12, with a simple hinge or pivot being used on the other side instead of the visor mounting system 100. Alternatively, the helmet 10 can be provided with a visor mounting system on both the left and right sides of the helmet shell 12, as per the illustrated embodiment. It should further be appreciated from the present disclosure that the visor mounting system offers improvements and advantages as described above. Indeed, the visor mounting system 100 is easy to operate and advantageously prevents inadvertent opening of the visor, even during freefall (i.e., when skydiving), where winds can reach speeds of up to about 300 km/h for example.

In addition, although the optional configurations as illustrated in the accompanying drawings comprise various components, and although the optional configurations of the skydiving helmet as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations thereinbetween, as well as other suitable geometrical configurations may be used for the helmet, and corresponding parts, as briefly explained and as can be easily inferred herefrom, without departing from the scope of the disclosure.

The invention claimed is:

1. A skydiving helmet comprising:

a helmet shell having a front opening;

a visor comprising a lateral mounting section, the visor being operable between a lowered position for covering the front opening, and a raised position, said lateral mounting section comprising a visor channel; and a visor mounting system laterally positioned on the helmet shell, and comprising:

a visor retaining pin insertable in the visor channel to pivotally connect the lateral mounting section of the visor to the helmet shell;

a base plate having a locking and guiding cavity formed therein, the locking and guiding cavity including a locking slot and an arcuate guiding section communicating with one another; and a locking element positioned within the locking and guiding cavity, the locking element being operable between an extended configuration for engaging with the locking slot and preventing rotation of the visor, and a retracted configuration for fitting within and moving along the arcuate guiding section, thereby allowing a frontward translation of the visor, away from the helmet front opening, and subsequent rotation of the visor, from the lowered to the raised position, wherein the visor retaining pin has a stem connected to the base plate, and a pin head connected at a distal end of the stem, the pin head being shaped and configured to extend at least partially over the visor channel, thereby retaining the lateral mounting section pivotally connected to the helmet shell, and wherein the locking element comprises a lock head, a lock base, and a resilient member extending between the lock head and lock base, the lock head being shaped and configured for engaging the locking slot, the lock base engaging with the stem of the visor retaining pin, and the resilient member biasing the lock head outwardly, away from the stem, such that the lock head engages the locking slot when aligned therewith.

2. The skydiving helmet according to claim 1, wherein the visor channel is sized and configured to retain the locking element therein when operating the locking element and/or pivoting the visor.

3. The skydiving helmet according to claim 1, wherein the visor channel is configured to align with the locking slot when the visor is in the lowered position.

4. The skydiving helmet according to claim 1, wherein the locking slot is recessed relative to the arcuate guiding section and includes sidewalls shaped and sized to constrain the motion of the locking element to a translational motion when in the extended configuration.

5. The skydiving helmet according to claim 1, wherein the locking element is operatively connected to the visor, and wherein the visor is configured to disengage the locking element from the locking slot via a forward translation of the visor.

6. The skydiving helmet according to claim 1, wherein the arcuate guiding section of the locking and guiding cavity comprises a stopper configured to limit movement of the locking element along the arcuate guiding section, thereby limiting rotational movement of the visor when the visor has reached the raised position.

7. The skydiving helmet according to claim 1, wherein the visor mounting system comprises a hub plate connected to the lateral mounting section of the visor such that moving the hub plate correspondingly moves the visor.

8. The skydiving helmet according to claim 7, wherein the hub plate is shaped and configured to cover the base plate and the locking element, and is further configured to operate the locking element from the extended configuration to the retracted configuration via a forward translation thereof.

9. The skydiving helmet according to claim 8, wherein the resilient member is a compression spring that limits forward translation of the hub plate.

10. The skydiving helmet according to claim 7, wherein the hub plate includes a gripping surface to facilitate moving the visor.

11. The skydiving helmet according to claim 7, wherein the lock head comprises a protrusion and the hub plate comprises a lock recess for receiving the protrusion and connecting the lock head to the hub plate.

12. The skydiving helmet according to claim 7, wherein the hub plate comprises a pin receiving cavity to receive the pin head therein and allow the pin head to slide and pivot within the pin receiving cavity when moving the hub plate.

13. The skydiving helmet according to claim 1, wherein the lock base of the locking element has an arcuate sidewall configured to pivot about the stem of the visor retaining pin when moving the locking element along the arcuate guiding section.

14. The skydiving helmet according to claim 1, wherein the arcuate guiding section of the guiding and locking cavity has an outer perimeter, and wherein a radial distance between the stem and the outer perimeter of the cavity is constant along the arcuate guiding section, whereby when the visor is rotated from the lowered to the raised positions, spacing between the helmet shell and the visor is constant such that movement of the visor is constrained to a rotational motion.

15. The skydiving helmet according to claim 1, wherein the arcuate section has an outer perimeter, and wherein a radial distance between the stem and the outer perimeter varies as distance away from the locking slot increases along the outer perimeter, whereby when the visor is rotated from the lowered to the raised positions, spacing between the helmet shell and the visor also varies.

16. The skydiving helmet according to claim 1, wherein the front opening has a recessed edge configured to block rotation of the visor when the visor is in the lowered position and the locking element is in the extended configuration.

17. The skydiving helmet according to claim 1, wherein the helmet shell and the base plate are formed as a one-piece unit.

* * * * *